US005419788A

United States Patent [19]

Thoma et al.

[11] Patent Number: 5,419,788

[45] Date of Patent: May 30, 1995

[54] EXTENDED LIFE SMA ACTUATOR

[75] Inventors: Paul E. Thoma, Cedarburg; Ming-Yuan Kao, Fox Point; Dwight M. Schmitz, West Allis, all of Wis.

[73] Assignee: Johnson Service Company, Milwaukee, Wis.

[21] Appl. No.: 164,901

[22] Filed: Dec. 10, 1993

[51] Int. Cl.[6] ..... C21D 8/00; C22F 1/00

[52] U.S. Cl. ..... 148/402; 148/421; 148/563; 420/902

[58] Field of Search ..... 148/402, 421, 563; 420/902

[56] References Cited

U.S. PATENT DOCUMENTS

| | | | |
|---|---|---|---|
| 4,531,988 | 7/1985 | Todoroki et al. | 148/402 |
| 4,849,032 | 7/1989 | Kawaguchi | 148/402 |
| 4,881,981 | 11/1989 | Thoma et al. | 148/402 |
| 4,919,177 | 4/1990 | Homma | 420/417 |
| 4,935,068 | 6/1990 | Duerig | 148/402 |
| 4,943,326 | 7/1990 | Ozawa et al. | 148/402 |
| 5,066,341 | 11/1991 | Grenouillet | 148/402 |
| 5,108,523 | 4/1992 | Peterseim et al. | 148/402 |
| 5,114,504 | 5/1992 | AbuJudom, II et al. | 148/402 |
| 5,226,979 | 7/1993 | Thoma | 148/402 |

OTHER PUBLICATIONS

Characterization of NiTi Shape Memory Wires By Differential Scanning Calorimetry And Transmission X-Ray Diffraction, Mat. Res. Soc. Symp. Proc. vol. 246, 1992 Materials Research Society.

Pushing The Limit To Achieve NiTi SMA Actuating Members That Are Dimensionally Stable And Have High Transformatino Temperatures, Mat. Res. Soc. Symp. Proc. vo. 246, 1992 Materials Research Society.

The Effect Of Cold Work And Heat Treatment On The Phase Transformations Of Near Equiatomic NiTi Shape Memory Alloy, Materials Science Forum vols. 56-58 (1990) pp. 565-570.

The International Conference on Martensitic Transformations, ICOMAT-89 Holiday Inn Menzies, Sydney, Australia, 3-7 Jul. 1989.

International Conference on Martensitic Transformations, ICOMAI-92, Monterey, Calif., 20-24 Jul. 1992.

Shaping Up Fastener Rings, Machine Design/Oct. 10, 1991, p. 34.

European Symposium on Martensitic Transformation And Shape Memory Properties, Sep. 16-18, 1991, Centre Paul Langevin, Aussois, France, C4-117.

Actuator 92, 3rd International Conference on New Acutators, Jun. 24-26, 1992, pp. 225-227.

*Primary Examiner*—Upendra Roy

*Attorney, Agent, or Firm*—Foley & Lardner

[57] ABSTRACT

The present invention relates to a method for increasing the useful life of a shape memory alloy (SMA) actuator, wherein the SMA element contracts on heating and elongates on cooling under an applied stress and that property is used as an actuating technique. More specifically, the present invention relates to the cooling aspect of the cycle and maintaining a martensite strain on the actuator SMA element at less than about 3% by limiting the upper stress on the element. In the most preferred embodiment, the element is a ribbon actuator prepared from a nickel-titanium SMA alloy.

13 Claims, 1 Drawing Sheet

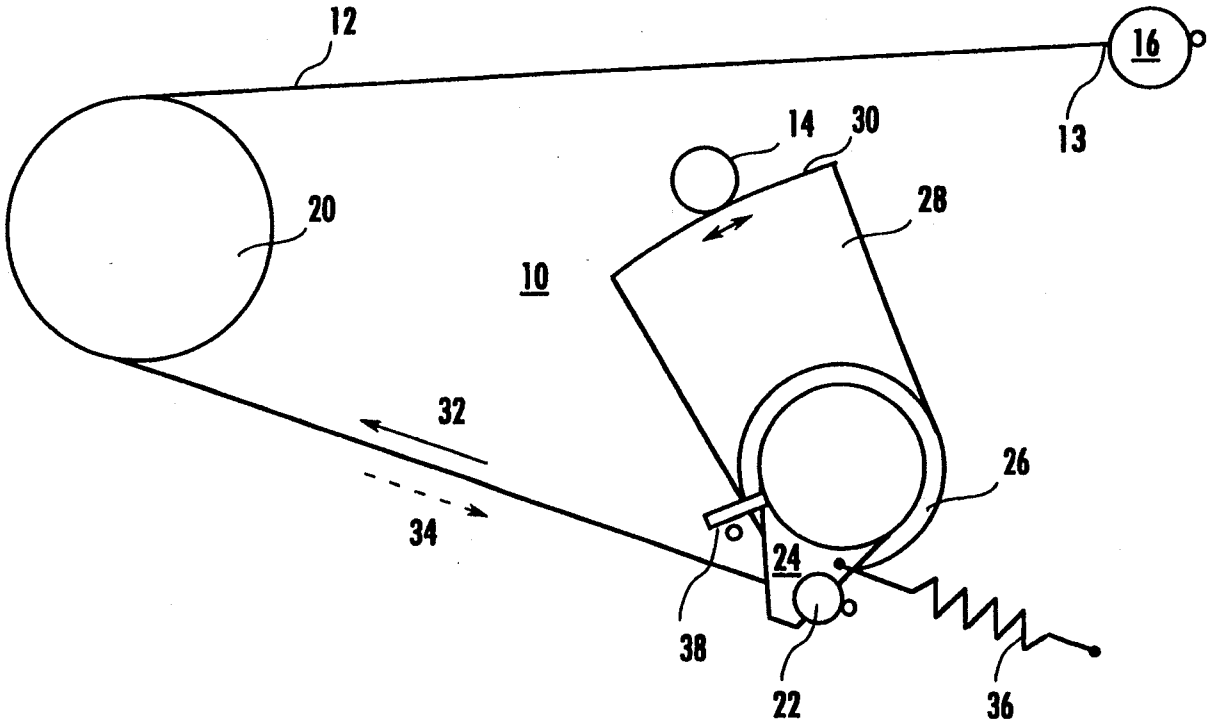
16
13
12
20
10
14
30
28
26
24
22
36
38
32
34

EXTENDED LIFE SMA ACTUATOR

BACKGROUND OF THE INVENTION

1. Field of the Invention

The present invention relates generally to the art of actuator devices which use a shape memory alloy (SMA) and its ability to do work when transforming from martensite to austenite. More specifically, the present invention relates to extending the useful life of such actuators by controlling the amount of martensite strain imposed on the SMA material to below about 3% by limiting the upper stress on the element. Still more specifically, the preferred embodiment of the present invention relates to providing an actuator device with a ribbon shape actuator prepared from a nickel-titanium SMA alloy which is capable of millions of cycles without failure.

2. Description of the Prior Art

Shape memory alloy (SMA) materials are well known. Shape memory alloys are those alloys which undergo a crystalline phase transition upon heating and cooling, and upon application or removal of stress. Normally, the transition from martensite to austenite and austenite to martensite occurs over a temperature range which varies with the composition of the alloy itself and the type of thermal-mechanical processing. When stress is applied to the SMA member in the austenite phase and cooled through the austenite to martensite transition temperature range, the austenite phase transforms to martensite, and the shape of the SMA member changes due to the applied stress. Upon heating, the SMA member returns to its original shape when the martensite transforms to austenite.

A large amount of prior art discusses the alloys themselves and techniques for improving the performance of alloys in certain applications. Nickel-titanium alloys having approximately a 50:50 ratio of these elements is one well known SMA material. Variations of this base alloy are also known. See, for example, U.S. Pat. No. 5,114,504, issued May 19, 1992 to AbuJudom, et al. for "High Transformation Temperature Shape Memory Alloy," and U.S. Pat. No. 5,109,523, issued Apr. 28, 1992 to Peterseim, et al. for "Shape Memory Alloy." Both patents, in their Background sections, provide additional basic information about the shape memory phenomenon and certain techniques for modifying the properties, usually the temperatures at which the relevant transformations take place.

Some attempts have also been made to modify the physical and mechanical properties of SMA, such as those discussed in Thoma, et al., U.S. Pat. No. 4,881,981, issued Nov. 21, 1989 and entitled "Method for Producing a Shape Memory Alloy Member Having Specific Physical and Mechanical Properties." In this patent disclosure, the internal stress of the SMA is increased by cold working, and the member is then formed into the desired configuration. The member is then heat treated at a selected memory imparting temperature. It is also known that the transformation temperatures may be stabilized by cycling the SMA element between martensite and austenite under an applied stress.

A wide variety of uses exist for SMA, including actuators for robotic devices, clamps and fasteners and for other applications where it is desirable to take advantage of the rather dramatic shape changes which accompany the phase transitions under an applied stress.

However, one problem with commercialization of SMA devices has been the relatively short useful life of the actuators, for causes which heretofore have not been fully appreciated. It has been difficult to design SMA actuators which can be uniformly heated and cooled and to provide actuators where thermal conduction is even along the actuator element, as opposed to inconsistent, e.g. in areas where the SMA contacts other actuator components such as pulleys and termination elements. In the past, high stress levels were applied to SMA elements during the austenite to martensite transition and the amount of SMA element strain was controlled with mechanical stops. A consequence of the high applied stress is that sections of the SMA element that cool below the austenite to martensite transformation temperature first will undergo martensite straining as much as 8% in the localized cooled section. Such problems are believed to result in SMA element deterioration and a reduction in useful life. SMA element failure occurs in the highly strained sections that cool first.

As an example of such problems, assume the SMA element is being used in a pulley containing switch, and an alloy is selected which may increase by as much as 5–8% in length when it transforms to the martensite phase under stress, compared to its original dimensions in the austenite phase. Problems can result if the element is not uniformly cooled, because the pulley (for example) will act as a heat sink for that portion of the element in contact therewith. The cooling will be uneven as pulleys and other actuator components will cause parts of the element to cool more rapidly or more slowly than others. The reverse situation will occur when heating of element takes place and the material returns to its original shape. This results in premature failure of the element.

Most prior art actuator elements are made from wire which has a circular cross-section, presumably because of ease of fabrication. It is known, however, that ribbons with a rectangular cross-section may be used for SMA elements. Such ribbons are believed to have improved performance due to their lower outer fiber stress when bent and increased surface area-to-volume ratio. Because ribbons with a rectangular cross-section have a greater surface area-to-volume ratio than circular cross-section members, they cool faster. It is also known that heat insulating materials can be used for the pulley and termination contact points to assist in eliminating hot and cold spots and uneven heat transfer to and from the SMA element.

With the known characteristics of SMA alloys and a considerable amount of knowledge about improvements in their physical and mechanical properties, commercialization of this technology has still proceeded slowly. Reliability seems to be a major factor in the slow growth of this exciting technology, and any improvement thereto would constitute a significant advance in the art.

SUMMARY OF THE INVENTION

The present invention features a method for enhancing the useful life of SMA elements and overcoming significant drawbacks of prior art devices as discussed in the foregoing section of this specification. The present invention, in one of its preferred embodiments, also features application of the method to an elongate, ribbon SMA actuator having a rectangular cross-section which is used in conjunction with other actuator components and has a greater rate of heat transfer when cooled. Uneven heat transfer to and from such other actuator components will be minimized by using heat insulating materials for the other actuator components.

The present invention also features a method for increasing the reliability of SMA systems which may be widely adapted to SMA elements of different configurations.

The present invention also features an actuator system which may be used for such applications as a damper control or switch for building control systems which has undergone in excess of 4 million heating-/cooling cycles before failure.

The present invention will be described below in connection with the most preferred embodiment and in conjunction with an illustrative actuator device. Generally, however, the method of the present invention, in its most preferred form, comprises maintaining less than about 3% and preferably less than about 2% martensite strain on the actuator element. This is accomplished in the illustrated embodiment by employing other actuator components, such as pulleys, spring tension and counterweights, which will ensure that as the SMA element is cooling from the austenite stage to the martensite stage, the maximum strain possible on any portion of the element while transforming to martensite will be less than about 3% of the element's austenite length. In other words, if the element is being used in an application where the total possible martensite strain of the element could be 5–8% or more of its length in the austenite stage, the present invention will limit the strained condition on the element during cooling to only that percentage which is less than about 3% by limiting the stress applied to the element. In the most preferred embodiment, a ribbon actuator having a high surface area-to-volume ratio is employed to maximize the cooling rate of the SMA material.

Other ways in which the invention provides the features described above will be discussed in the following sections of this specification, and still other ways in which the invention may be employed will become apparent to those skilled in the art after the specification is read and understood. Such other ways are also deemed to fall within the scope of the present invention.

DESCRIPTION OF THE DRAWING

The FIGURE illustrates an SMA ribbon actuator according to one preferred form of the present invention.

DETAILED DESCRIPTION OF THE PREFERRED EMBODIMENT

Before proceeding to the detailed description of the preferred embodiment, several general comments should be made as to the intended scope and applicability of the present invention. First, the number of actuators which are known for use with SMA elements is considerable, and the illustrative embodiment is shown for purposes of illustration and it is not to be taken as limiting in any way. Second, the invention is applicable to any number of SMA materials, including but not limited to those specifically described and generally referred to in the patents mentioned earlier. Third, while the invention is illustrated in connection with a ribbon-type actuator (i.e., one with a rectangular cross-section), round wire actuator elements, or elements of other configuration, will benefit from the method of the present invention.

Proceeding now to the FIGURE, there is shown an SMA ribbon actuator system 10 in schematic form. Actuator 10 includes an elongate ribbon SMA element 12, arranged with associated components to drive an output shaft 14, as would be used for an application such as control of a damper or other system in a building control device. A first end 13 of element 12 is fixed at a termination 16 (preferably one which is made of low thermal conductivity material and/or mechanical design to assist in maintaining low heat transfer. Element 12 then passes around a guide pulley 20 (also preferably made of or coated at its contact areas with thermally insulating material) and proceeds to a second termination 22 which is pivoted on an extension 24 of the drive pulley 26 to minimize the bending stress. A control flange 28 extends from the drive pulley 26 toward the output shaft 14 and contacts same along surface 30 so that the output shaft 14 will rotate as the drive pulley 26 is rotated about its axis. Other arrangements could obviously be used without departing from the intended scope of the invention.

A solid line arrow 32 and dotted line arrow 34 are shown in the FIGURE, the former representing the direction of movement of termination 22 when element 12 is heated, i.e. element 12 decreases in length as it passes from the martensite to austenite stage (all assuming, of course, that the heating temperature is above the transformation temperatures for the particular SMA selected). The dotted arrow, on the other hand, shows the direction of movement of termination 22 when element 12 is cooled, i.e. when element 12 increases in overall length as it goes from the austenite to martensite stage (again, assuming the cooling temperature is below the applicable transformation temperature). A tension spring 36 is schematically shown on the drive pulley 26 to urge the drive pulley to rotate in a counter-clockwise direction. Spring 36 is selected in present invention to limit the maximum possible amount of martensite strain on element 12 to less than about 3%, which is accomplished by the spring providing a near constant force or providing a maximum force to limit the maximum stress on element 12 that results in less than about 3% martensite strain. In lieu of spring 36, a number of equivalent well known mechanical devices could be used to limit the stress on element 12 which limits the amount of martensite strain, e.g. counterweights, etc. A strain stop assembly 38 is positioned to also limit the maximum martensite strain to less than about 3%. The strain stop assembly 38 is a safety stop to prevent overstraining of the SMA element.

As mentioned previously, the output shaft 14 could be coupled to a variety of devices, such as an air control damper. Similarly, the way in which heating and cooling of element 12 could be accomplished could be widely varied. Normal ambient conditions may be employed for both heating and cooling, or in some cases it may be desirable to "force" a transition in one direction or the other, depending on the nature of the final end use for the actuator. For example, a fan could be used to force cooling air over the element 12 to ensure more rapid and preferably more even cooling during the austenite to martensite transition. Alternatively, resistance heating could be employed to force the martensite to austenite transition if that were the desired objective.

While nickel-titanium alloy SMA materials such as those described elsewhere in this specification are preferred, others may be employed. Our preferred embodiment involves the use of a 49.2 at. % nickel-50.8 at. % titanium wire rolled to a 7×50 mils. cross-section, accomplished by cold rolling a 27.5 mil. diameter wire having a 68.8° C. $M_S$ (the starting temperature for the martensite transformation) in an annealed state. The ribbon was memory imparted heat treated at 400° C. for 1 hour in vacuum and was then cycled 200 times between austenite and martensite at an axial stress of 27,000 psi to stabilize the dimensional length and transformation temperatures of the ribbon. After such treatment, the $M_S$ had been altered to 52.6° C. Under a load of 17,000 psi, a 73° C. $M_S$ was noted with a stroke of about 3%. More than 4 million cycles were accumulated without any sign of failure or memory loss. A reset time with forced air cooling was approximately 7.5 seconds.

In addition to flattening a die drawn circle cross-section wire, die drawing using progressive rectangular profile dies or Turks Head forming techniques could be used to make rectangular cross-section ribbons.

While the present invention has been described in connection with only a single preferred embodiment, several substitutions and equivalents have been referred to. Accordingly, the invention is not to be limited to the foregoing description, but is to be limited solely by the scope of the claims which follow.

What is claimed is:

1. An actuator employing an elongate shape memory alloy element and relying on the elongation and contraction properties of the element to effectuate a control operation, the element undergoing transition from martensite state to austenite state upon heating and from austenite state to martensite state upon cooling, the improvement comprising:

means for applying a maximum longitudinal force on the element during cooling to limit the stress on the element to maintain a martensite strain of less than about 3% on the element during cooling of the element.

2. The actuator of claim 1, wherein the element is produced from a shape memory alloy comprising predominantly titanium and nickel.

3. The actuator of claim 1, wherein the element is an elongate ribbon having a generally rectangular cross-section.

4. The actuator of claim 1, wherein contact surfaces between the element and other actuator components are provided with a thermal insulation to assist in preventing localized temperature fluctuations along the length of the element.

5. The actuator of claim 1, wherein the element has been cold worked, heat treated, and stabilized by cycling under a constant stress to set desirable transition temperatures and stabilize the dimensions of the element.

6. The actuator of claim 1, wherein the element has a pivoted termination on at least one end.

7. The actuator of claim 1, wherein a mechanical stop limits the strain of the actuator element to less than about 3% martensite strain.

8. A method for increasing the useful life of an actuator which includes an elongate shape memory alloy element under stress capable of contracting in length upon heating as it undergoes a martensite to austenite phase transition and an elongation in length upon cooling as the reverse phase transition occurs, comprising the step of:

maintaining the element under a maximum longitudinal force to limit the stress on the element to result in a condition of less than about 3% martensite strain during cooling.

9. The method of claim 8, wherein the element is made from an alloy predominantly comprising nickel and titanium.

10. The method of claim 8, wherein the element is an elongate ribbon having a generally rectangular cross-section.

11. The method of claim 8, comprising the step of cold working and heat treating the element before assembly of the actuator and cycling the element between the austenite and martensite phases under longitudinal stress to establish desirable transition temperatures for the element and stabilize the dimensions of the element.

12. The method of claim 8, wherein the element has a pivoted termination on at least one end.

13. The method of claim 8, further comprising use of a mechanical stop to limit the strain of the actuator element to less than about 3% martensite strain.

* * * * *